United States Patent [19]

Feeser

[11] 4,325,482

[45] Apr. 20, 1982

[54] FLIP TOP, RECLOSABLE CARTON

[75] Inventor: Larry R. Feeser, Cincinnati, Ohio

[73] Assignee: The Procter & Gamble Company, Cincinnati, Ohio

[21] Appl. No.: 208,719

[22] Filed: Nov. 20, 1980

[51] Int. Cl.[3] ..... B65D 5/54; B65D 5/66

[52] U.S. Cl. ..... 206/625; 229/44 CB

[58] Field of Search ..... 206/624, 625, 621, 626; 229/44 CB

[56] References Cited

U.S. PATENT DOCUMENTS

| | | | |
|---|---|---|---|
| Re. 26,185 | 4/1967 | Henry . | |
| 149,889 | 4/1874 | Smith | 229/44 CB |
| 395,886 | 1/1889 | Emery . | |
| 2,011,438 | 8/1935 | Daller | 229/44 CB |
| 2,038,893 | 4/1936 | Davidson | 206/624 |
| 2,122,885 | 7/1938 | Lowey | 229/33 |
| 2,361,597 | 10/1944 | Buttery | 229/44 |
| 2,951,627 | 9/1960 | Wenzel | 229/44 |
| 3,050,233 | 8/1962 | Burgess | 229/44 |
| 3,078,030 | 2/1963 | Gorton | 229/44 |
| 3,167,238 | 1/1965 | Smith . | |
| 3,207,416 | 9/1965 | Kultz et al. | 229/44 |
| 3,283,991 | 11/1966 | Hughes | 206/625 |
| 3,438,565 | 4/1969 | Lugt et al. | 229/17 |
| 3,531,032 | 9/1970 | Miles, Jr. | 225/48 |
| 3,708,108 | 1/1973 | Rosenburg, Jr. | 229/44 CB |
| 3,861,583 | 1/1975 | Tingley | 229/DIG. 9 |
| 3,910,486 | 10/1975 | Stone | 229/44 CB |
| 3,942,712 | 3/1976 | Bundy et al. | 229/44 R |
| 4,048,052 | 9/1977 | Tolaas | 206/625 |
| 4,083,455 | 4/1978 | Keating, Jr. | 206/625 |

FOREIGN PATENT DOCUMENTS

| | | | |
|---|---|---|---|
| 794700 | 9/1968 | Canada | 206/624 |
| 1462915 | 1/1977 | United Kingdom | 229/44 CB |

*Primary Examiner*—Stephen P. Garbe

*Attorney, Agent, or Firm*—Richard C. Witte; John V. Gorman; Thomas H. O'Flaherty

[57] ABSTRACT

A flip top reclosable dispenser carton formed that includes a top wall, back wall, bottom wall, front wall and a pair of opposed side walls. The front wall includes an upper front wall and a lower front wall. The upper front wall has an arcuately-shaped edge adapted to tuck behind and to be held in place by the lower front wall and the lower front wall is preferably somewhat shorter than the rear wall such that after erection and opening of the carton the product contained therein is visible to the consumer in front and is easily accessible. The side walls each include an inner, an outer and an intermediate wall. Each of the inner walls include a closure flap hingedly connected to the back wall. Each of the outer walls include an upper closure flap hingedly connected to the upper front wall and a lower closure flap hingedly connected to the lower front wall. Each of the intermediate walls include a top closure flap hingedly connected to the top wall, a lower closure flap hingedly connected to the bottom wall and a glue flap connected to the upper closure flap of the outer side wall by a line of weakness.

3 Claims, 8 Drawing Figures

FLIP TOP, RECLOSABLE CARTON

TECHNICAL FIELD

The present invention relates to reclosable flip-top cartons and, more particularly, to cartons having a receptacle portion and a cover portion initially connected by lines of weakness. The cover portion pivots relative to the receptacle portion and has a front panel with an arcuate edge for tucking behind the receptacle portion's front panel for reclosure. The carton is designed to contain individually folded product sheets, packets, or any products for which a flip-top, reclosable carton is useful to provide easy access to the product contained therein.

BACKGROUND ART

Reclosable flip top cartons are not new in the art. For example, U.S. Pat. No. 3,942,712 issued to P. L. Bundy on Mar. 9, 1976 discloses a carton having lock tabs on the cover portion adapted to engage V-shaped slits in the receptacle portion for reclosing and having lines of weakness initially connecting the cover and receptacle portions. U.S. Pat. No. 4,048,052 issued to W. M. Tolaas on Sept. 13, 1977 comprises a reclosable cover portion hingedly connected to a receptacle portion by a score line at the top edge of the rear receptacle panel. The carton is opened by severing lines of weakness on both sides and the carton is reclosed by mating the leading edge of a locking flange hingedly connected to the top edge of the front receptacle panel with a slit on the inner section of the front cover panel. U.S. Pat. No. 4,083,455 issued to M. Keating, Jr. on Apr. 11, 1978 discloses a carton having inside front panel flaps on the cover portion adapted to mate with downwardly extending front panel flaps on the receptacle portion for locking and having lines of weakness diagonally positioned along both side walls to initially connect the cover portion to the receptacle portion.

In addition, the use of an arcuate edge on the front panel of a cover portion adapted for reclosing a carton is known. U.S. Pat. No. 3,078,030, issued to R. T. Gorton on Feb. 19, 1963 discloses a carton comprising a tongue panel that is sandwiched between an outer front cover panel and an inner front cover panel and that is adapted to mate with a cutout section of the front panel of the receptacle portion. The carton is initially opened by severing lines of weakness along both carton sides connecting the cover portion with the receptacle portion. U.S. Pat. No. 3,861,583 issued to W. E. Tingley and J. Addiego on Jan. 21, 1975 discloses a reclosable carton having a closure panel on the cover portion with an arcuate edge that inserts into a slit in the front panel of the receptacle portion. Lines of weakness are provided along the front panel of the receptacle portion to initially connect the closure panel to the front receptacle panel. U.S. Pat. No. 2,361,597 issued to K. T. Buttery on Oct. 31, 1944 discloses a box or container having a rectangular-shaped tongue extending from the front panel of the cover portion that is adapted to fit into a slit on the front panel of the receptacle portion. Lines of weakness are positioned horizontally along both side walls for initial connection of the cover portion to the receptacle portion.

Finally, it is known to employ an arcuate shaped edge on the front panel of a cover portion of the carton to simply tuck behind the front panel of the receptacle portion for reclosing. U.S. Pat. No. 395,886 issued to W. H. Emery on Jan. 8, 1889 discloses a carton having a front closing flap that ends in a generally arcuate shape and which is designed to tuck behind an outer front flap and in front of an inner front flap for carton closure.

The prior art discloses a number of means for providing initial closure of the carton and for reclosure after opening. Frequently, the prior art cartons employ relatively complex mating panel sections for reclosure or require the insertion of a tongue element into a mating slot. The carton elements involved in these types of reclosures are easily damaged after repeated use. In addition, the more complex reclosure designs require substantially more board than relatively simple reclosures. Even when the reclosure means is relatively simple, the carton is usually designed to require a rather precise manipulation of a reclosure tongue or panel element into a slot or between an inner and an outer wall.

Additionally, the design for the lines of weakness that initially close the carton has been primarily directed at ensuring that the carton will not open during shipment. As a consequence, the lines of weakness are often overdesigned and tend to require considerable effort to sever. None of the prior art cartons make use of a simple reclosure design comprising an arcuate edge on the reclosure panel that simply tucks behind the front wall, in combination with lines of weakness on both sides of the carton designed to be the minimum necessary to prevent the carton from opening during shipment. The combination results in a package that makes very efficient use of board and is easily opening and easily reclosed. The consumer does not need to pull tear strips, fight the adhesive seal, struggle with severing the lines of weakness nor struggle with trying to reclose the carton.

Therefore, it is an object of the present invention to provide a carton that requires only simple, gross manipulation to effect reclosure.

It is a further object of the present invention to provide a carton that can be opened with a minimum of force and yet is capable of withstanding the rigors of shipping.

Finally, it is an object of the present invention to provide a carton that uses a minimum of board and can be erected on standard carton assembly equipment and is therefore economical to manufacture.

DISCLOSURE OF THE INVENTION

This invention provides for a flip top dispenser carton formed from a unitary paperboard blank. The carton includes a front wall, back wall, top wall and bottom wall forming the main body of the carton and a pair of opposed side walls. The front wall includes a lower front wall hingedly connected to the bottom wall and an upper front wall hingedly connected to the top wall and that is tucked behind and held in place by the lower front wall. The back wall is hingedly connected at its top edge to the top wall and at its bottom edge to the bottom wall. Each of the side walls include an inner wall, an outer wall and an intermediate wall. The inner side walls are hingedly connected to opposite sides of the back wall and are approximately the same height as the back wall along the hinge lines. The outer side walls each include a lower closure flap and an upper closure flap. The lower closure flaps are hingedly connected to opposite sides of the lower front wall and the upper closure flaps are hingedly connected to opposite sides of the upper front wall. The intermediate side walls each include a top closure flap, a lower closure flap and glue flap. The top closure flaps are hingedly connected to opposite sides of the top wall and are adhesively attached to and have the same overall dimension and shape as the upper closure flaps of the outer side walls. The lower closure flaps are hingedly connected to opposite sides of the bottom wall and are adhesively attached to the lower closure flaps of the outer side walls. The glue flaps are connected to the upper closure flaps of the outer side wall by lines of weakness and are adhesively attached to the lower closure flaps of the outer side walls and are positioned such that the lines of weakness are generally aligned with the top edges of the lower closure flaps of the outer side walls.

BRIEF DESCRIPTION OF THE DRAWINGS

Further objects and advantages of the invention will become apparent from the following description and claims, and from the accompanying drawings, wherein:

DETAILED DESCRIPTION OF THE INVENTION

Figure 1:
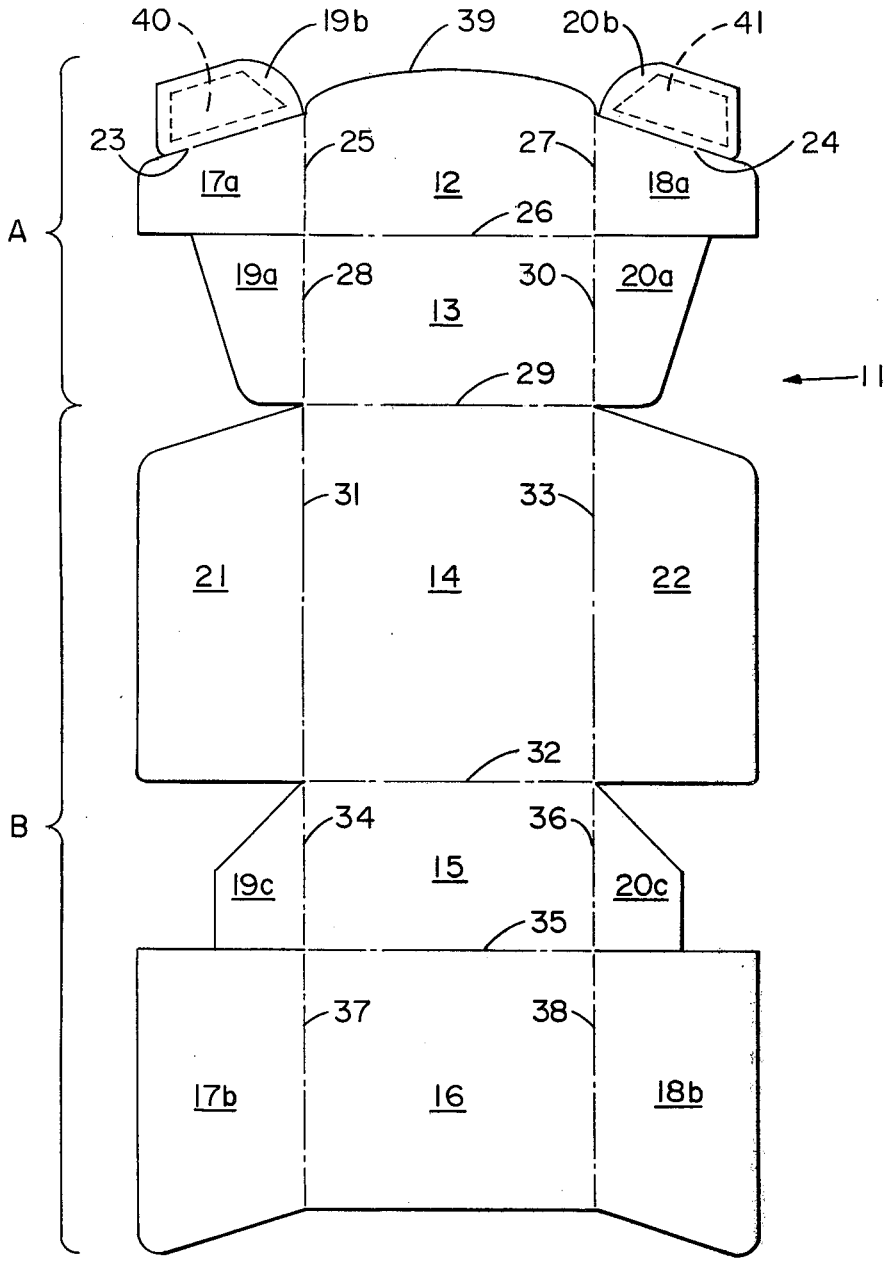
FIG. 1 is a plan view of the inner (unprinted) surface of a blank for forming one embodiment of a carton of the present invention.

Referring now to the drawings in detail, wherein like numerals indicate like elements throughout the several views, the carton 10 of the present invention is erected from a single, unitary paperboard blank 11 as shown in FIG. 1. Blank 11 includes five vertically aligned generally rectangular walls which form the main body of the carton 10: the upper front wall 12 having an arcuately shaped free edge 39 and rounded corners where the free edge 39 joins to score lines 25 and 27, top wall 13, back wall 14, bottom wall 15 and lower front wall 16.

In addition, each of these walls include left and right laterally extending closure flaps. The upper front wall 12 includes closure flaps **17*a* and 18*a* hingedly connected at score lines 25 and 27 and adapted to form the upper closure flaps of the outer side walls. Top wall 13 includes closure flaps 19*a* and 20*a* hingedly connected at score lines 28 and 30 and adapted to form the top closure flaps of the intermediate side walls. Back wall 14 includes closure flaps 21 and 22 hingedly connected at score lines 31 and 33 and adapted to form the inner side walls and are approximately the same size as the back wall 14 along the score lines 31 and 33, respectively, and taper downwardly along the top edge. Bottom wall 15 includes closure flaps 19*c* and 20*c* hingedly connected at score lines 34 and 36 and adapted to form the lower closure flaps of the intermediate side walls. The lower front wall 16 includes closure flaps 17*b* and 18*b* hingedly connected at score lines 37 and 38 and adapted to form the lower closure flaps of the outer side walls. The upper closure flaps 17*a* and 18*a* of the outer side walls further include glue flaps 19*b* and 20*b* connected to the upper closure flaps 17*a* and 18*a* by lines of weakness 23 and 24**.

After the blank 11 is initially cut and scored, an adhesive is applied to the outer surface of the glue flaps **19*b* and 20*b* as indicated at 40 and 41, respectively. Care needs to be exercised in applying the adhesive as excess adhesive could seep across the lines of weakness 23 and 24 making it difficult to sever the lines of weakness 23 and 24** and open the carton after the carton is erected.

Figure 2:
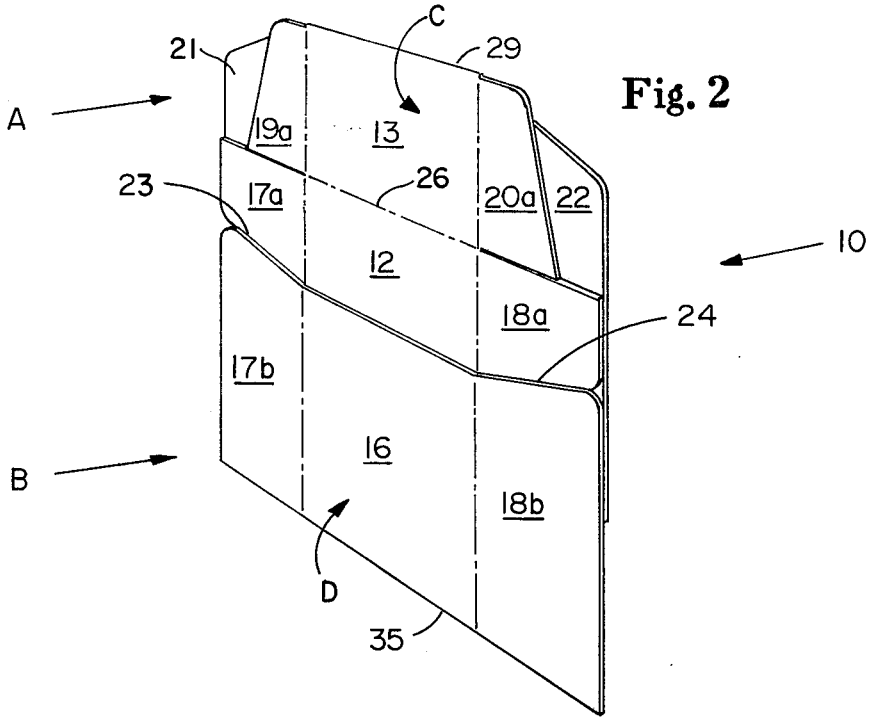
FIG. 2 is a perspective view of the blank of FIG. 1 as it is folded to form the manufacturer's joint.

After applying the adhesive to the glue flaps **19*b* and 20*b* the carton is then folded, as shown in FIG. 2, to form a manufacturer's joint by folding the top wall 13, 180° about score line 29 as indicated by directional arrow C into face-to-face contact with back wall 14 and then lower front wall 16 is folded 180° about score line 35 as indicated by directional arrow D. At this point the lower closure flaps 17*b* and 18*b* of the outer side wall are positioned such that they completely cover glue flaps 19*b* and 20*b*, respectively, and the adhesive at 40 and 41 bonds the lower closure flaps 17*b* and 18*b* to the glue flaps 19*b* and 20*b* such that the lines of weakness 23 and 24 are in general alignment with the top edge of the lower closure flaps 17*b* and 18*b* and also in general alignment with the lower edge of the top closure flaps 19*a* and 20*a* after the carton has been erected. Also, the arcuately shaped edge 39 of the upper front wall 12 is positioned behind the lower front wall 16 and the upper front wall 12 and the lower front wall 16** now form the carton's front wall.

Figure 3:
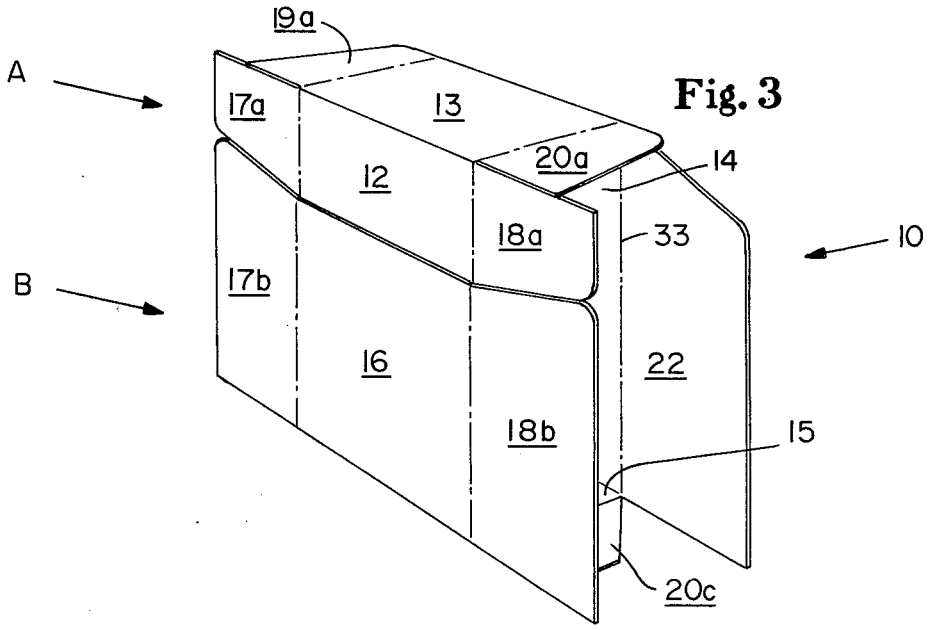
FIG. 3 is a perspective view of the carton of FIG. 1 after it is squared and ready for loading.

After forming the manufacturer's joint the carton 10 of FIG. 2, a flat sleeve, can be brought to the squared position shown in FIG. 3 by breaking score lines 32 between back wall 14 and bottom wall 15 and score line 26 between upper front wall 12 and top wall 13. The erected carton 10 is now ready for side loading of the product.

Figure 4:
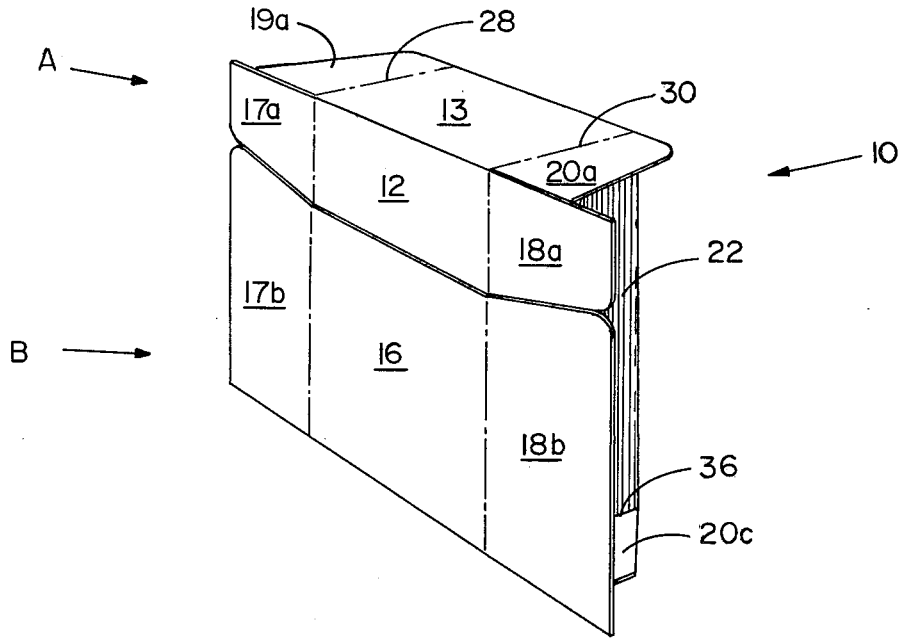
FIG. 4 is a perspective view of the carton of FIG. 1 after loading and folding the inner side wall closure flaps into place.
Figure 5:
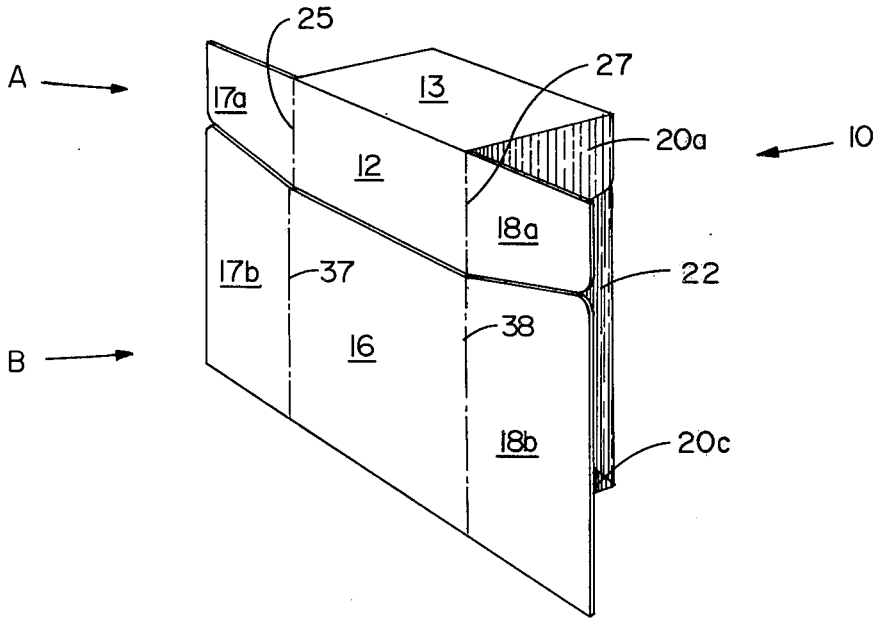
FIG. 5 is a perspective view of the carton of FIG. 1 after the top and lower closure flaps of the intermediate side walls are folded into place.

Once the carton 10 is filled with its intended product the side walls can be formed to complete assembly of the carton. First the inner side wall closure flaps 21 and 22 are folded 90° along score lines 31 and 33, respectively, as shown in FIG. 4. Next the lower closure flaps **19*c* and 20*c* are folded 90° along score lines 34 and 36; and, at the same time, the top closure flaps 19*a* and 20*a* are folded 90° along score lines 28 and 30 to the postion as shown in FIG. 5** to form the intermediate side wall.

At this point adhesive is applied to the inner surfaces of the upper closure flaps **17*a* and 18*a* and the lower closure flaps 17*b* and 18*b*. Care needs to be exercised in applying the adhesive. If too much adhesive is applied to the upper closure flaps 17*a* and 18*a* some of the adhesive may seep under the top closure flaps 19*a* and 20*a* and bond the top closure flaps 19*a* and 20*a* to the inner side wall closure flaps 21 and 22, respectively. If this occurs, the carton cannot be opened without breaking this adhesive bond between the top closure flaps 19*a* and 20*a* and the inner side wall closure flaps 21 and 22, thereby making carton opening very difficult. After applying the adhesive, upper closure flap 17*a* and lower closure flap 17*b* are folded together along score lines 25 and 37, respectively, and upper closure flap 18*a* and lower closure flap 18*b* are folded together along score lines 27 and 38, respectively, to complete closing of the carton 10**.

Figure 6:
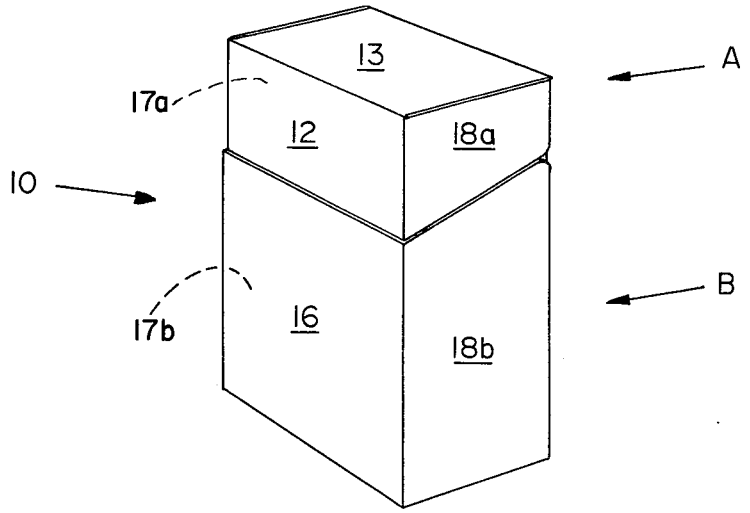
FIG. 6 is a perspective view of the erected carton formed from the blank of FIG. 1 with the cover closed.
Figure 7:
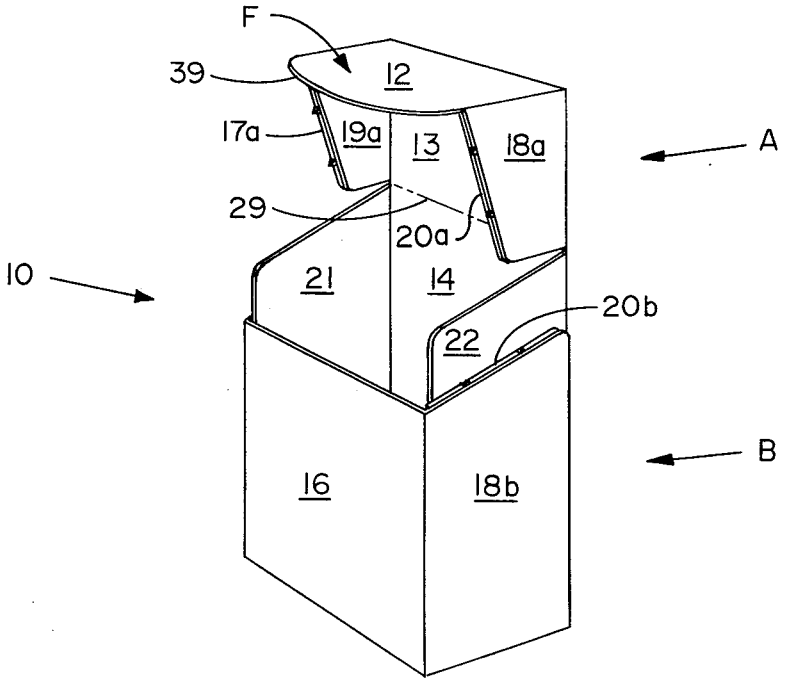
FIG. 7 is a perspective view of the erected carton of FIG. 1 with the cover portion open.

The assembled carton 10, shown in FIG. 6, can be generally divided into an upper or cover portion A and a lower or receptacle portion B with the cover portion A and receptacle portion B being hingedly connected at score line 29 and also being connected before carton opening by lines of weakness 23 and 24. To open the carton 10 and expose the product contained therein the consumer must hold and immobilize the receptacle portion B of the carton, apply a slight inwardly-directed force to the upper closure flaps 17*a* and 18*a* of the outer side walls sufficient to sever the lines of weakness 23 and 24 respectively and then pivot the cover portion A of the carton 10 about score line 29 as shown in FIG. 7. Since the lower front wall 16 is shorter than back wall 14 the product is now visible and easily accessible to the consumer.

To reclose the carton 10 after the consumer has removed the desired amount of product, the consumer again needs to immobilize the receptacle portion B and then apply a slight inwardly directed force on the upper front wall 12 and guide the arcuate-shaped edge 39 so that it tucks behind the lower front wall 16. The natural spring in the fiberboard will generally cause the intermediate side wall top closure flaps 19*a* and 20*a* and the outer side wall upper closure flaps 17*a* and 18*a*, bonded together to form the cover portion A side walls, to flex and clear the inner side wall closure flaps 21 and 22. However, the carton will function just as well in reclosing even if the consumer ends up having one of the cover portion A side walls inside one of the inner side wall closure flaps 21 and 22 (NOTE: It is virtually impossible to get both of the cover portion A side walls inside of both of the inner wall closure flaps 21 and 22 without forcing them.) By following these relatively simple steps the carton can be opened and closed repeatedly and since there is a minimum of panel contact or interaction the opening and closing can be accomplished with minimal degradation of the panels that interact.

The carton is easily opened initially by designing the lines of weakness 23 and 24 such that they have a minimum of nicks sufficient only to withstand the rigors of shipping. It has been determined that for one embodiment of the preferred carton with final dimensions of 8.3 cm×4.8 cm×10.7 cm and intended for use with lightweight product sheets, only two nicks per side with each nick being from 1/64" to 3/64" wide are required where the carton is constructed from solid bleached sulfate, 16 point board. Of course cartons constructed from heavier gauge board could be provided with smaller nicks as would be evident to one of ordinary skill in the art.

Figure 8:
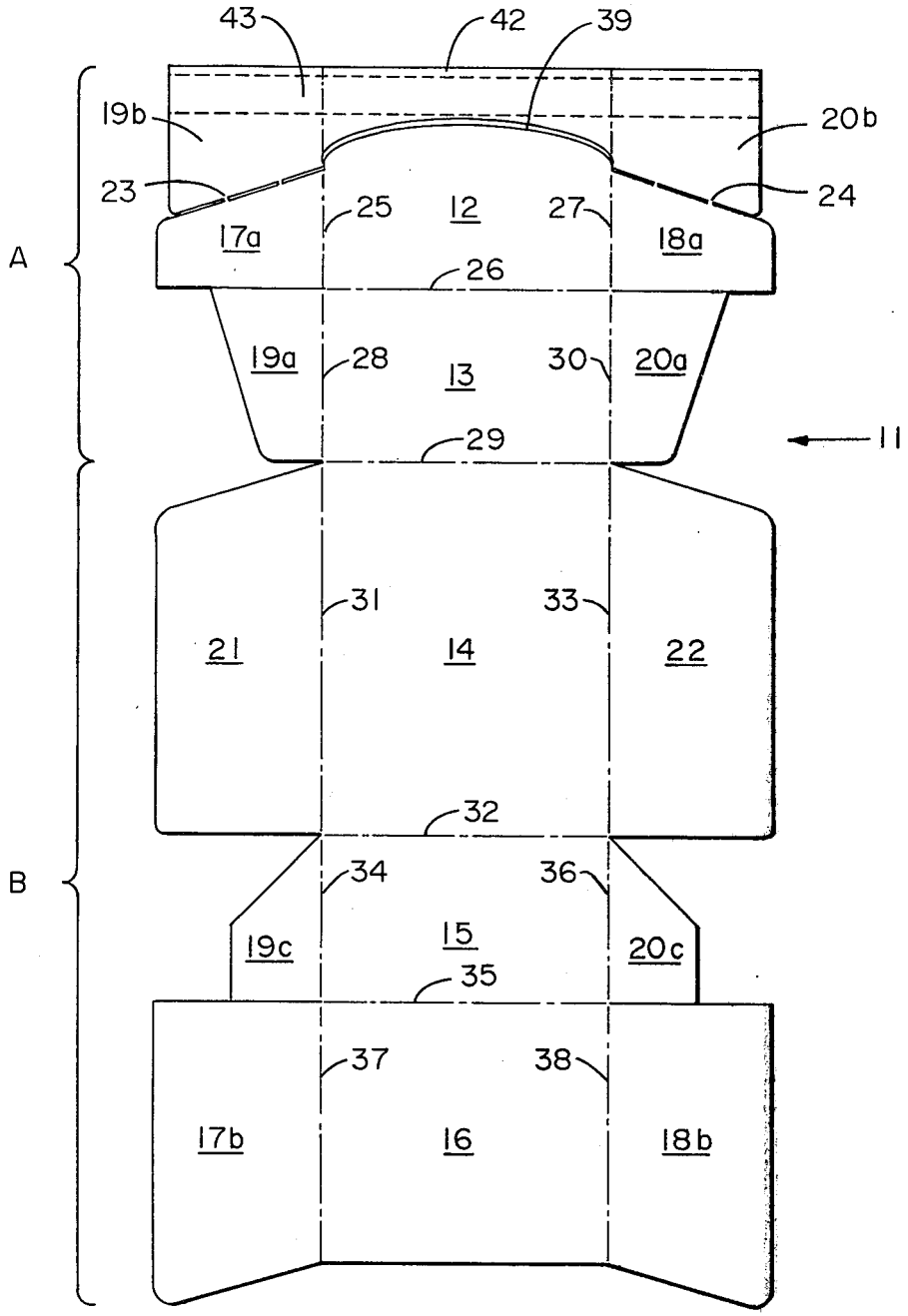
FIG. 8 is a plan view of a blank for forming a further embodiment of the carton of the present invention.

Normally, the initial adhesive application, in this case onto the glue flaps 19*b* and 20*b* at 40 and 41, is part of the carton making process, i.e., the manufacturer's joint. The carton manufacturer can apply the adhesive in several ways. The conventional method would be to use either a timed or skip gluer set to apply the adhesive only on each of the glue flaps 19*b* and 20*b* on blank 11. If it is desired to apply a continuous bead of adhesive to cartons of the present invention, the carton can be modified to accept it. Such a modified carton, shown in FIG. 8, would include a glue flap connection panel 42 and slightly modified glue flaps 19*b* and 20*b*. A stripe of adhesive could be placed along path 43 sufficient to adhere the glue flaps 19*b* and 20*b* to the inner surface of the lower closure flaps 17*b* and 18*b*, respectively, and to adhere the connection panel 42 behind lower front wall 16. One preferable and accurate method for applying the adhesive is to have a heat activated adhesive printed on the carton board prior to cutting and scoring of the blank. One such adhesive is Latiseal A7734A or Latiseal A7734AL supplied by The Pierce & Stevens Chemical Corporation, Division of Pratt & Lambert Inc., 724 Ohio Street, Buffalo, N.Y. 14203. The Latiseal adhesive is an aqueous, fastdrying dispersion containing heat reacting thermoplastic resins and it is heated in order to effect a bond. The Latiseal adhesive is printed onto the board, the board is cut and scored to the blank, and the blank is run under a heat lamp to activate the adhesive when the manufacturer's joint is effected. Having shown and described the preferred embodiment of the present invention, various improvements and modifications thereof will be readily apparent to those skilled in the art. Accordingly the scope of the present invention should be considered in terms of the following claims and is understood not to be limited to the details of structure and operation shown and described in the specification and drawings.

I claim:

1. A flip top reclosable dispenser carton comprising:

(a) a front wall, back wall, top wall, bottom wall and a pair of opposing side walls;

(b) said front wall including a lower front wall hingedly connected to said bottom wall and an upper front wall tucked behind and held in place by said lower front wall, the upper end of said upper front wall being hingedly connected to said top wall;

(c) each of said side walls including an inner side wall, an outer side wall and an intermediate side wall;

(d) each of said inner side walls being hingedly connected to said back wall and approximately the same height as said back wall along said hinge line;

(e) each of said outer side walls including a lower closure flap hingedly connected to said lower front wall and an upper closure flap hingedly connected to said upper front wall;

(f) each of said intermediate side walls including a top closure flap hingedly connected to said top wall and being adhesively attached to and having the same overall dimension and shape as said upper closure flap of said outer side wall, a lower closure flap hingedly connected to said bottom wall and being adhesively attached to said lower closure flap of said outer side wall, and a glue flap being connected to said upper closure flap of said outer side wall by a line of weakness and further being adhesively attached to said lower closure flap of said outer side wall such that said lines of weakness is in general alignment with the top edge of said lower closure flap of said outer side wall and the lower edge of said top closure flap of said intermediate side wall.

2. The carton of claim 1 wherein said glue flaps are adhesively attached to said lower closure flaps of said outer side wall by means of a heat activated adhesive printed onto the outer surface of said glue flaps.

3. The carton of claim 1 wherein said glue flaps are connected by and integrally formed with a connection panel being adhesively attached to the interior surface of said lower front wall and having an edge adjacent to and complementary to said edge of said upper front wall that tucks behind said lower front wall.

* * * * *